US006374416B1

(12) United States Patent
Baranauskas

(10) Patent No.: US 6,374,416 B1
(45) Date of Patent: Apr. 23, 2002

(54) ARCHERY BOW STRING FINGER GLOVE TECHNICAL SCOPE

(76) Inventor: Alfons V. Baranauskas, 9956 Johnny Cake Rd. Unit M-10, Concord, OH (US) 44077

( * ) Notice: Subject to any disclaimer, the term of this patent is extended or adjusted under 35 U.S.C. 154(b) by 0 days.

(21) Appl. No.: 09/553,685

(22) Filed: Apr. 21, 2000

Related U.S. Application Data

(60) Provisional application No. 60/130,686, filed on Apr. 23, 1999.

(51) Int. Cl.[7] ..... A41D 19/00
(52) U.S. Cl. ..... 2/161.5
(58) Field of Search ..... 2/161.5, 21, 163, 2/161.6, 161, 161.1, 161.4

(56) References Cited

U.S. PATENT DOCUMENTS 2,769,179 A * 11/1956 Love
2,974,319 A * 3/1961 Wilson et al.
2,985,885 A * 5/1961 Layer
3,229,034 A * 1/1966 Brooks
3,608,090 A * 9/1971 Wilson et al.
4,097,931 A * 7/1978 Hirose
5,220,690 A * 6/1993 Hoos

OTHER PUBLICATIONS

Bear Achery Model No. 3383–050, Archery Glove.
Bear Achery Model No. 7795, No–Pinch Tab.

* cited by examiner

*Primary Examiner*—Rodney M. Lindsey
(74) *Attorney, Agent, or Firm*—Renner, Otto, Boisselle & Sklar, LLP

(57) ABSTRACT

An archer's glove comprising a finger back section and a plurality of finger protectors for protecting a plurality of fingers of a user's hand, the plurality of finger protectors extending from the finger back section. A finger fastening strap extends from the finger back section for releasably securing the finger back section to the plurality of fingers of the user's hand.

32 Claims, 5 Drawing Sheets

ARCHERY BOW STRING FINGER GLOVE TECHNICAL SCOPE

APPLICATION DATA

This application claims the benefit under 35 U.S.C. 119(e) of U.S. Provisional Patent Application No. 60/130,686, filed on Apr. 23, 1999.

TECHNICAL SCOPE

The present invention relates to archery equipment that can be used in both hunting and target archery. In particular, the present invention relates to an apparatus for comfortably finger drawing and finger releasing a bow string and provides an improved finger glove for protecting the archers' finger tips during casual or repetitive bow string use.

BACKGROUND ART

It is well known that in both field and target archery it is essential during bow use to wear a finger apparatus with protective features to substantially reduce or minimize the severe discomfort that a bow string user endures during bow string draw and release. The finger apparatus can assist the user in maintaining a painless sustained complete bow string draw length to improve arrow accuracy along with eliminating premature arrow release to benefit archery safety. Such an apparatus should also offer a reusable securement means for repetitive on, off and back on the hand use. Failure to minimize finger stress and associated pains often result in a failure to maintain a full draw length thus reducing arrow speed and providing an unfairness to the hunted quarry. Archery finger gloves, particularly those intended for repetitive bow string draw and release usage should provide the archer with adequate finger protection along with an adjustable glove to finger securement means that can be secured to the archers bow string drawing hand entirely off the wrist joint, to reduce a blood flow restriction to the hand, and preferably fastenable around the customary three fingers used during bow string draw and release. Additionally, such gloves should be durable to both excessive wear and to the elements of weather found in the field.

SUMMARY OF THE PRESENT INVENTION

The present invention pertains to a durable and repetitive use finger glove for use by an archer. The invention provides adequate finger tip protection by offering a means as in finger tip stalls for keeping separate the bow string from the users sensitive finger tips during bow string draw and especially during bow string release since the release episode creates a maximum of stress to the skin surfaces of the archers bow string drawing fingers. Inadequate protection can result in damage to the dermis areas nearest the tip ends of the phalanges opposite the finger nails thus causing severe acute pain and possibly resulting in the bow being dangerously mishandled. Such an apparatus must offer enough dermis and pain protection during usage to eliminate unwarned firing of a bow in use along with enough protection to undraw a bow string prior to arrow release. Therefore it is essential to wear an apparatus to protect the fingers during all bow string draw and release episodes to successfully and safely utilize an archery target or hunting bow.

It is an object of the present invention to provide an improved archery finger glove which is of durable material and construction, held self attended and properly in place without constant user supervision and one in which the archer has maximum unrestricted free motion in the wrist joint area of the gloved hand.

It is an object of the present invention to provide an improved archery finger glove which is arranged for secure attachment to the archers customary three bow string drawing and release fingers by means of an adjustable finger fastening strap that encircles the three fingers that the apparatus protects during bow string draw and release.

It is an object of the present invention to provide an improved archery finger glove wherein the finger back cuff section offers finger fastening strap check means thus not allowing the strap to readily reverse itself in the finger back cuff tunnel.

It is another object of the present invention to provide an improved archery finger glove wherein the releasable mated ends of the finger fastening strap are positioned to be protected by the underside area of the users customary three protected fingers of the gloved hand.

It is still another object of the present invention to provide an improved archery finger glove wherein the adjustable finger fastening strap is fitted through a cuff tunnel at the finger back cuff section resulting in a users loop which encircles the finger base area of the archers customary (three) bow string drawing fingers therefore providing a maximum of in place securement for the finger glove onto the protected fingers for the purpose of, should the mating Velcro means become separated the glove remains unattended entirely in place on the protected fingers.

It is yet another object of the present invention to provide an improved archery finger glove wherein the fastening strap can be worn, adjusted and secured in place thus coupled to the users hand off the wrist joint yet is able to be removed and then later returned completely onto the fingers without readjusting and resecuring the finger fastening strap's original adjustment.

DETAILED DESCRIPTION OF THE PREFERRED EMBODIMENTS

Figure 1:
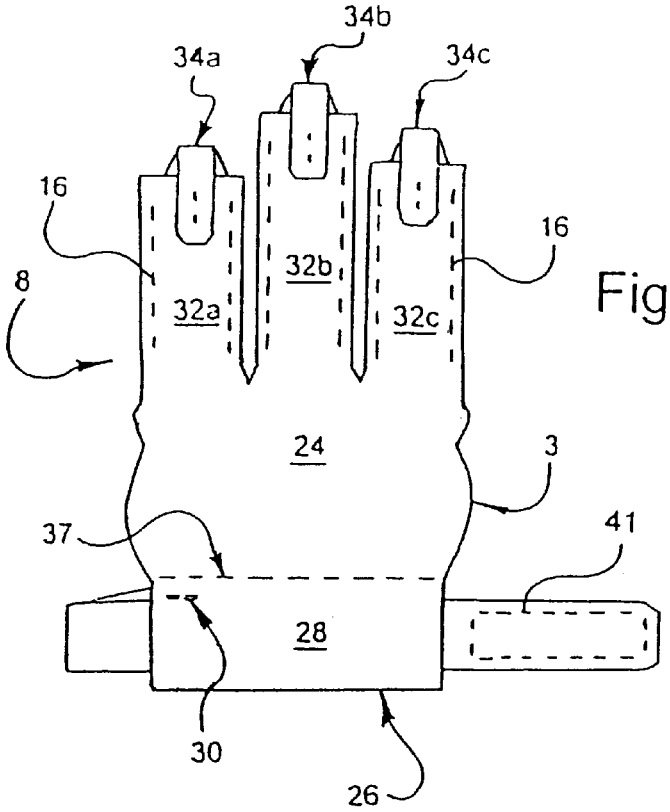
FIG. 1 is a top view of an archery glove in accordance with the present invention, the glove shown not in use.
Figure 2:
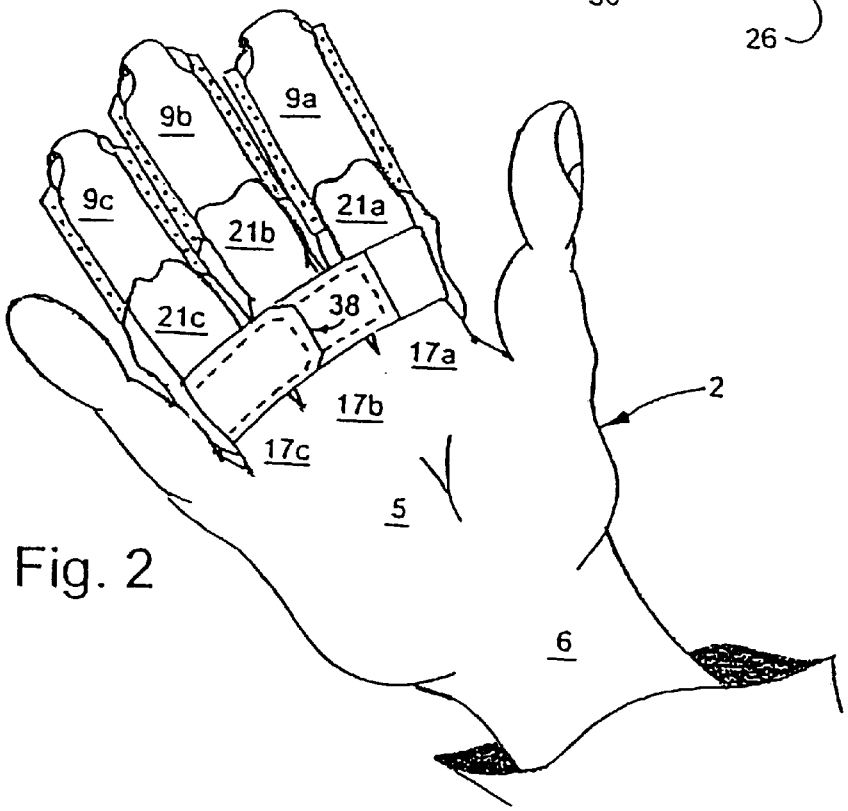
FIG. 2 is a composite underside view of the archery glove of the present invention and a users hand.
Figure 3:
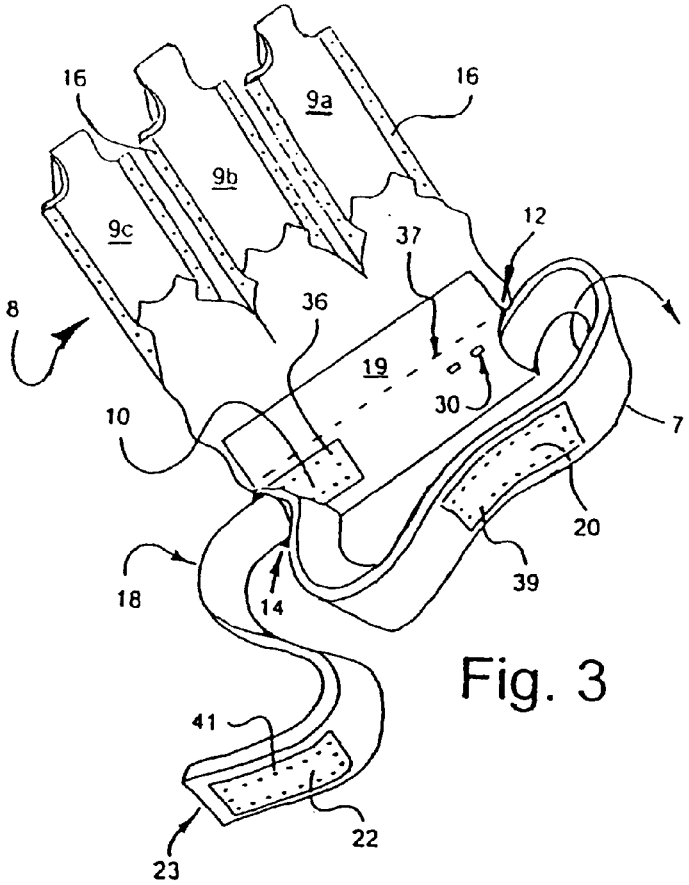
FIG. 3 is a perspective bottom view of the archery glove of the present invention, the glove shown not in use.

Referring to FIG. 1 and FIG. 3, there is shown an archery finger glove 8 in accordance with the present invention. The archery finger glove 8 includes a one piece finger back section 24 comprising a plurality of, preferably three, finger back extensions 32*a–c* on a tip end wherein each extension 32*a–c* is independently movable of its adjacent extension 32*a–c*. Each extension 32*a–c* has permanently fixed to its under side an enlarged finger tip stall 9*a–c*. Each of the stalls 9*a–c* is open at its distal end and is secured and partially closes the openings by guards 34*a–c* at finger tip ends 4*a–c*. The finger back section 24 at the opposing end comprises a cuff section 26 formed to include a finger back cuff tunnel 28 maintained open for its entire length. Adjustable securing means such as a finger fastening strap 18 is provided as shown in FIG. 3. The securing means 18 is connected at an anchor point 10 to the under side of the finger glove 8 by means of, for example, stitching 36. An opposing loose tip end 23 of the finger fastening strap 18 is drawn completely through the finger back cuff tunnel 28 after passing a check stitch 30 thus forming a users loop 7. The loop 7 is drawn and cinched taught around the base of an archers fingers 1*a–c* on the archers bow string drawing hand 2. Near the anchor point 10 and on the loose tip end 23 of the finger fastening strap 18 resides customary loops 22 and customary hooks 20 for providing a reusable bond 38 (FIG. 2) for securing the strap 18 at a taught adjustment around the archer's fingers 1*a–c*.

In accordance with the present invention, the finger tips 4*a–c* of the index, middle, and third finger 1*a–c* are adequately protected with minimal blood flow restriction while the hand 2, and more specifically the wrist joint 6 section has no restriction. It can also be observed that an unique improvement is provided by the glove 8 regarding the specific mating location 15 of mating means 20 and 22 (FIG. 3) of the finger fastening strap 18, wherein the mating location 15 is protected by the palm side 5 (FIG. 2) of the natural cupped fingers 1*a–c* of the gloved hand 2. Therefore the strap 18 offers a substantial improvement of finger glove 8-to-drawing fingers 1*a–c* securement means in comparison to conventional archery gloves. A herein before described finger back section 24 is formed to include a finger back cuff section 26 (FIG. 1) comprising a finger back cuff tunnel 28. The finger back cuff tunnel 28 is formed by first folding an extended tapered free end 19 (FIG. 3) of the cuff section 24 down as viewed in FIG. 3, then in towards the finger back extensions 32*a–c* and finally securing a portion of the free end 19, which may be tapered, to the underside of the finger back section 24. Transverse stitching 37 (FIGS. 1 and 3) secures the entire width of the free end 19 to the finger back section 24 providing an open arrangement for the cuff tunnel 28 and thus completing the finger back cuff section 26. The cuff tunnel 28 provides the improvement needed to house the adjustable fastening strap 18 as best illustrated in FIG. 3 of the drawings and herein before described. The cuff tunnel 28 runs substantially the entire width of the cuff section 26 and forms two cuff tunnel orifices 12 and 14 (FIG. 3). The cuff tunnel orifice 12 is located on the index finger side 1*a* of the glove 8 and receives the free tip end 23 of the finger fastening strap 18. Next the end 23 is pushed past the check stitch 30 (FIGS. 1 and 3) then drawn to emerge from the cuff tunnel orifice 14 located on the third finger side 1*c* of the glove 8. The above described tunnel drawing of the fastening strap 18 is an improvement which results in the unique users loop 7. The tunnel drawing can be done by an unspecified manufacture if desired or by the user, for example, after purchase by the user. The glove 8 can now be fitted onto the user's bow string drawing hand 2 wherein the users index, middle and third fingers 1*a–c* are first inserted through the loop 7 then the finger tips 4*a–c* are inserted into their appropriate finger tip stalls 9*a–c*. The strap 18 can then be used as a cinching means wherein when the strap 18 is pulled taught, it snugs around the base of the users three customary bow string drawing phalanges 1*a–c* (FIG. 4) at a general location between knuckles 17*a–c* and next phalange knuckles 21*a–c* (which are located towards the finger tips 4*a–c*) best illustrated in FIG. 2 of the drawings. The strap 18 remains in the tunnel 28 due to check stitching 30 wherein should the reusable bond 38 of the mated ends 20 and 22 at location 15 become unmated the stitching 30 provides a narrowed cuff tunnel 28 reversal resistance means for impeding adjustment slippage from the initial adjustment of the unmated fastening strap 18 thereby permitting the glove 8 of the present invention to remain properly on the archers 40 (FIG. 5) three drawing fingers l*a–c* adequately to continue safe operation of a bow in use. The finger fastening strap 18 is at one of its ends permanently connected at anchor 10 to the underside of the finger glove 8 at a location nearest the finger back cuff section 26 specifically connected to, for example as by sewing, the cuff tunnel 28 at the third finger 1*c* side or near the cuff tunnel orifice 14 and is permanently secured with a typical edge perimeter seam 36. Located on the outer side of the users loop 7 on the fastening strap 18 approximately one inch from the anchor point 10 in the exemplary embodiment shown in the Figures resides a customary Velcro hooks base securing means 20 permanently secured by a typical edge perimeter seam 39. At the tip most end 23 of the fastening strap 18 resides the customary Velcro loops base securing means 22 and this is also permanently secured by a typical edge perimeter seam 41. The securing means 20 and 22 are intended to be mated as by pressing them together in an overlapping manner thus resulting in an adjustable, releasable and reusable bond 38. This is best illustrated in FIG. 2 in the drawings.

Figure 5:
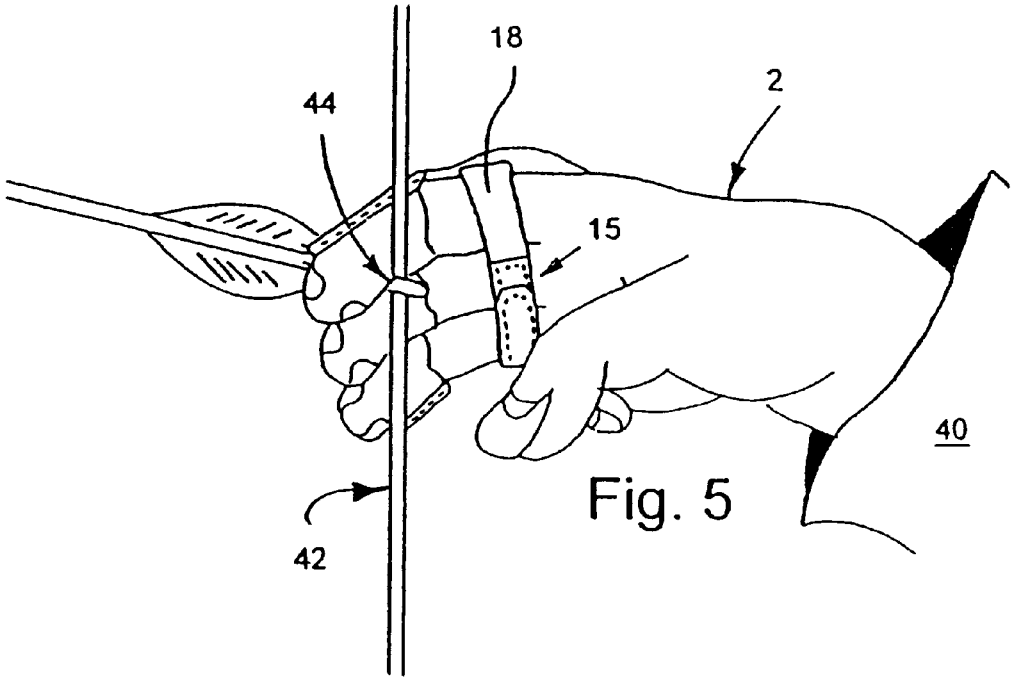
FIG. 5 is a side view of the archery glove of the present invention and a users hand while in use.
Figure 3A:
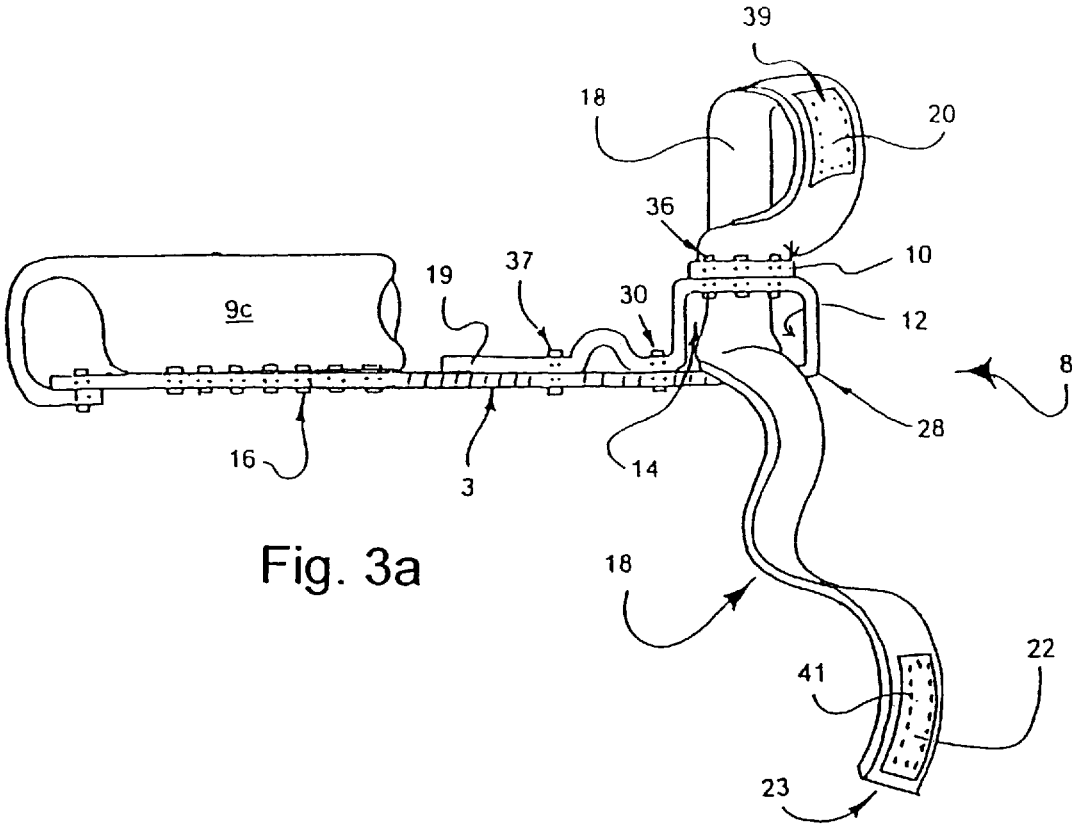
FIG. 3*a* is a side elevational view of the archery glove of the present invention, the glove shown not in use.
Figure 4:
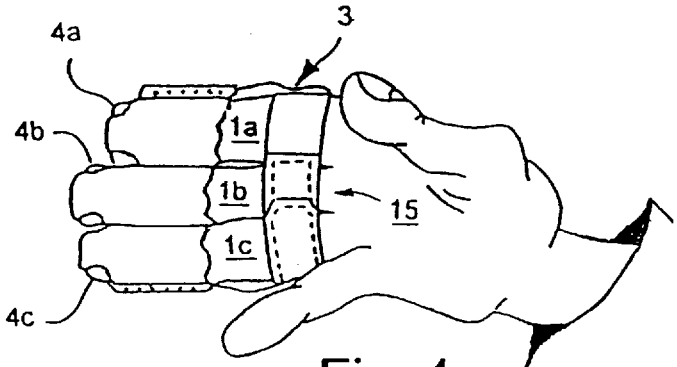
FIG. 4 is a composite side view of the archery glove of the present invention and a users hand.

Referring to FIG. 4 and FIG. 5 the finger back section 24 on its one end forms a plurality of three separate finger back extensions 32*a–c* (FIG. 1) opposite the finger back cuff section 26. Each extension 32*a–c* has attached thereto an enlarged finger tip stall 9*a–c* that can be easily fitted over the outside of the archers 40 three drawing finger tips 4*a–c* wherein 32*a* corresponds to 9*a* and 4*a*, wherein 32*b* is corresponds to 9*b* and 4*b*, wherein 32*c* is corresponds to 9*c* and 4*c*. The finger tip stall 9*a* while in use is placed finger print side against the bow string 42 above the arrow nock 44 while finger tip stalls 9*b* and 9*c* are placed on the string 42 below the arrow nock 44 in the customary fashion. The finger tip stalls 9*a–c* are herein before described permanently secured to the under side of the glove 8 nearest the tip end of each extension 32*a–c* by extending longitudinal seams 16. The seams 16 run the majority of the stalls 9*a–c* length preferably on both sides of the outer two edges thereof thus joining the finger back section 24 to the finger tip stalls 9*a–c*. Each stall 9*a–c* has a protection feature as in an extended stall guard center portion 34*a–c* (FIG. 1). Each center portion 34*a–c* is turned up, back, centered and permanently joined by typical stitching to the outside tip end of each extension 32*a–c*, best illustrated in FIG. 1 of the drawings, thus protecting the actual dermis surfaces of the archers 40 finger tips 4*a–c* from any direct contact with the bow string 42. The finger back section 24 preferably consists of a denser or thicker appropriate material in comparison to the material thickness of each finger tip stall 9*a–c*. For example, the thickness of the finger back section may be twice as thick, or twice as rigid or dense, as the thickness as the thickness of the finger tip stalls. This variation in material thickness is to accommodate the necessary bow string 42-to-finger tip 4*a–c* feel or touch required for warned firing of an archery bow string 42; i.e., a thinner material enables a user to more easily sense that the arrow is firing. The finger back section 24 is preferably formed broader at its general mid section 3 (FIGS. 1 and 4) thus providing briar protection to the archers hand 2. This broadened mid section 3 is best illustrated in FIG. 1 of the drawings. A herein before described improvement can also be observed in FIG. 1, wherein the finger back cuff tunnel 28 is slightly reduced at the index finger orifice 12 by an isolated check stitch 30. The stitch 30 is sewn entirely through both the material of the cuff tunnel 28 and through the finger back section 24. The stitch 30 assists the finger fastening strap 18 to remain at its cinched adjustment. A herein before described additional improvement can be observed in FIG. 2, wherein the Velcro mated means location 15 is clearly protected near the less exposed palm area 5 of the archers 40 hand 2 thus reducing the likelihood that the mated means 20 and 22 will become separated while the glove 8 user is traversing in dense brush.

It will occur to those skilled in the art of archery that the finger glove 8, while illustrated and herein before described as being positioned on the back side of the archers 40 right hand 2, may be alternately manufactured and positioned for use on the users left hand if desired.

Figure 7:
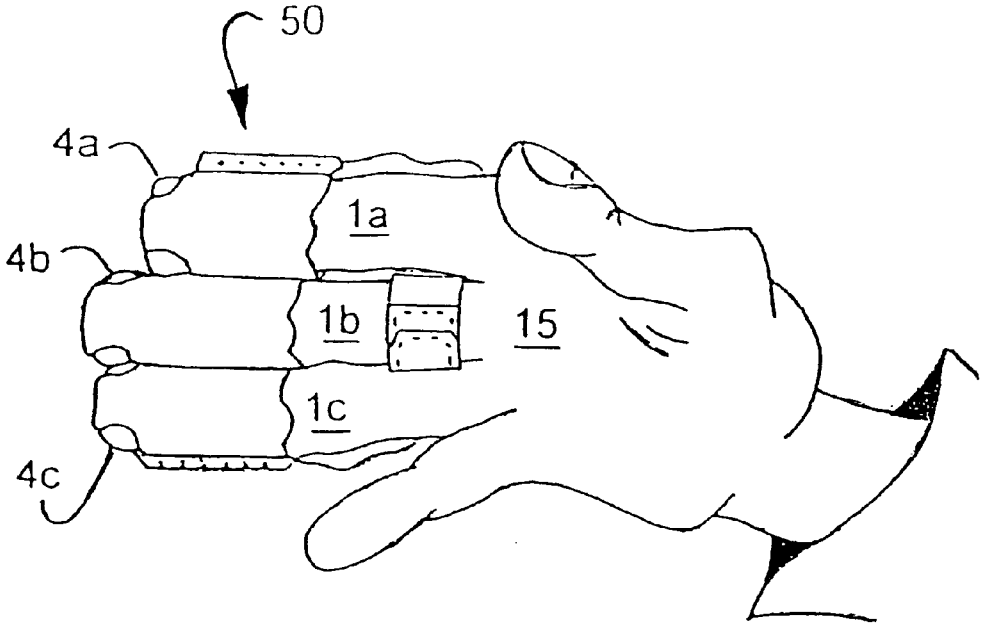
FIG. 7 is a composite side view of the FIG. 6 archery glove of the present invention and a user's hand.
Figure 6:
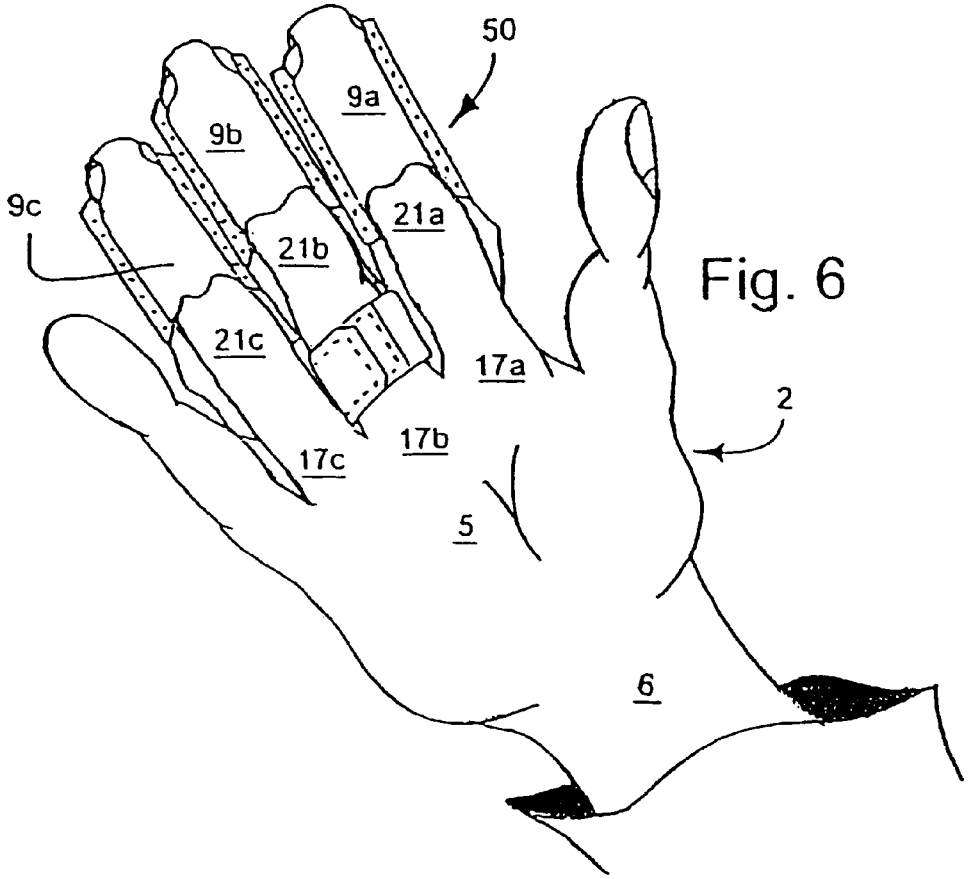
FIG. 6 is a composite under side view of an archery glove in accordance with another embodiment of the present invention and a user's hand.

FIGS. 6 and 7 show another embodiment of an archery glove 50 in accordance with the present invention. In the several Figures like reference numerals correspond to like components and parts Here the finger fastening strap is adapted to wrap around only one finger. Of course the presently claimed invention contemplates an archery glove including a finger fastening strap adapted to wrap around one or more fingers. To this end, the finger fastening strap is shorter in width, as is the finger back cuff section and more particularly the finger back cuff tunnel through which the finger fastening strap passes.

Figure 9:
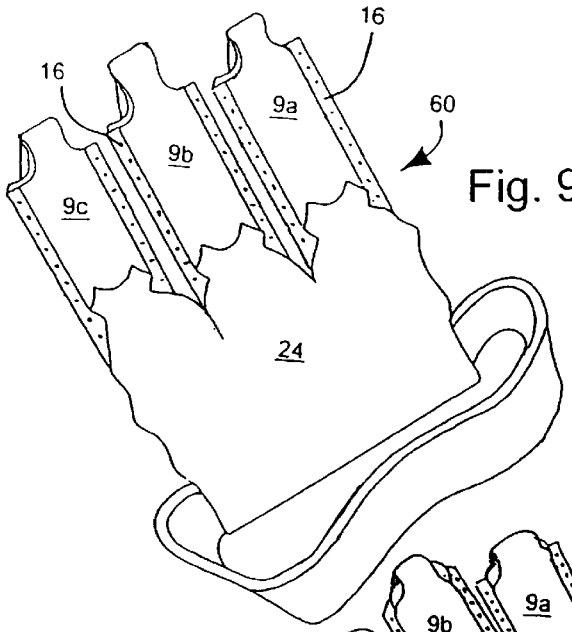
FIG. 9 is a perspective bottom view of the FIG. 8 archery glove of the present invention, the glove shown not in use.
Figure 8:
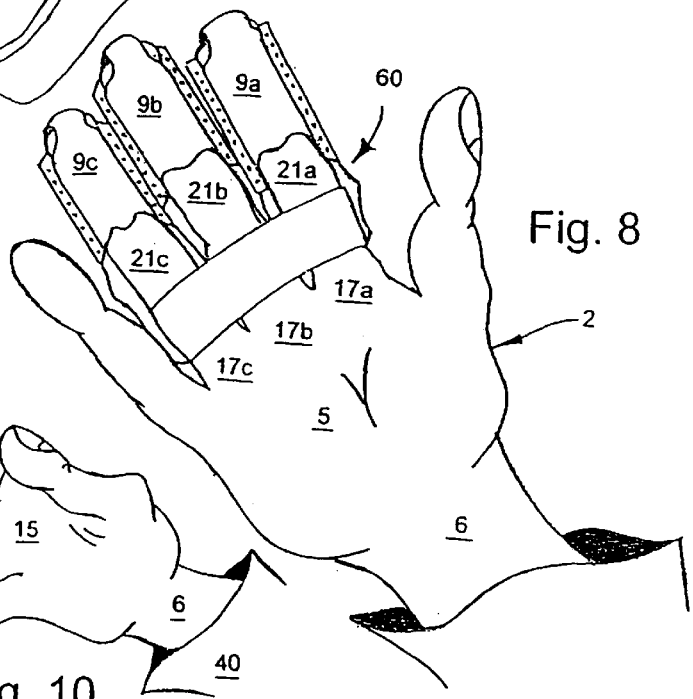
FIG. 8 is a composite under side view of an archery glove in accordance with yet another embodiment of the present invention and a user's hand.
Figure 10:
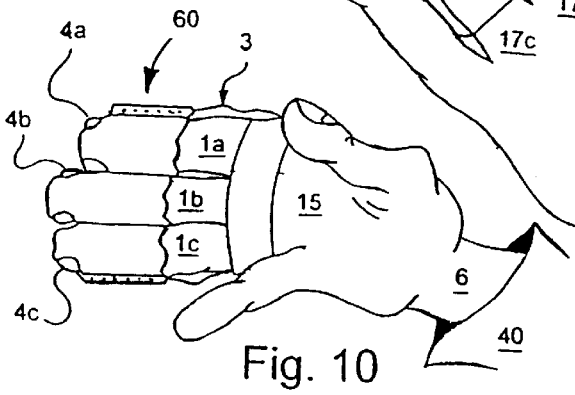
FIG. 10 is a composite side view of the FIG. 8 archery glove of the present invention and a user's hand.

FIGS. 8–10 show yet another embodiment of an archery glove 60 in accordance with the present invention. In the several Figures, like reference numerals correspond to like components and parts. It will be appreciated that the finger fastening strap need not include a mating location or bond. Thus the finger fastening strap need not have a loose tip end requiring, for example, the afore described mating means. The finger fastening strap, or user's loop, of the archery glove 60 may be integrally formed as part of the finger back section thereof, or the finger fastening strap may be attached, as by stitching, to the finger back section. The material of the finger fastening strap, or user's loop, may be an elastic band type material whereby a user need only simply expand the user's loop to insert the user's fingers there through and then release the user's loop thereby causing it to wrap around the user's fingers to secure the finger back section to the user's fingers.

The present invention may be embodied in other specific forms without departing from the essential attributes thereof. It is desired that the embodiments described above may be considered in all respects as illustrative, not restrictive, reference being made to the appended claims to indicate the scope of the invention.

What is claimed is:

1. An archer's glove comprising:

a finger back section and a plurality of finger protectors for protecting a plurality of fingers of a user's hand, the plurality of finger protectors extending from the finger back section; and a finger fastening strap extending from the finger back section for releasably securing the finger back section to the plurality of fingers of the user's hand;

wherein the finger back section includes a finger back cuff tunnel through which the finger fastening strap passes, the finger back cuff tunnel being adapted to extend in a direction transverse the plurality of fingers of the user's hand when the archer's glove is arranged with respect to the user's hand.

2. An archer's glove as set forth in claim 1, wherein at least a portion of the finger fastening strap is integrally connected to the finger back section.

3. An archer's glove as set forth in claim 1, wherein the finger fastening strap is adapted to wrap around one or more of the plurality of fingers of the user's hand.

4. An archer's glove comprising:

a finger back section and a plurality of finger protectors for protecting a plurality of fingers of a user's hand, the plurality of finger protectors extending from the finger back section; and a finger fastening strap extending from the finger back section for releasably securing the finger back section to the plurality of fingers of the user's hand, wherein the finger back section includes an extended free end which is folded to an underside of the finger back section and connected thereto to form a finger back cuff tunnel through which the finger fastening strap passes.

5. An archer's glove as set forth in claim 1, wherein the finger back section includes a midsection which is broader in width than the width of the plurality of finger protectors.

6. An archer's glove as set forth in claim 1, wherein the finger fastening strap includes a free end that mates with another portion of the finger fastening strap at a mating location thereof to secure the finger back section to the plurality of fingers of the user's hand.

7. An archer's glove as set forth in claim 6, wherein the mating location is adapted to be at a palm side of the plurality of fingers of the user's hand.

8. An archer's glove as set forth in claim 6, wherein the mating of the free end and the other portion of the finger fastening strap form a bond, the bond being adjustable, releasable and reusable.

9. An archer's glove as set forth in claim 6, wherein the mating of the free end and the other portion of the finger fastening strap is by connecting of Velcro loops and hooks.

10. An archer's glove as set forth in claim 1, wherein the finger fastening strap is connected at an anchor point at an underside of the finger back section.

11. An archer's glove as set forth in claim 10, wherein the connection includes a stitch.

12. An archer's glove comprising:

a finger back section and a plurality of finger protectors for protecting a plurality of fingers of a user's hand, the plurality of finger protectors extending from the finger back section; and a finger fastening strap extending from the finger back section for releasably securing the finger back section to the plurality of fingers of the user's hand, wherein the plurality of finger protectors includes a plurality of finger back extensions which form part of the finger back section and a plurality of finger tip stalls attached to the respective finger back extensions, the plurality of finger back extensions and finger tip stalls being adapted to receive therebetween the respective plurality of fingers of the user's hand.

13. An archer's glove as set forth in claim 12, wherein the finger back section is made of a material having a higher density than that of the material of the finger tip stalls.

14. An archer's glove as set forth in claim 12, wherein the finger tip stalls have open ends at finger tip portions thereof.

15. An archer's glove as set forth in claim 14, wherein the finger tip stalls include respective finger tip guards which at least partially cover the respective open ends at the finger tip portions and connect to the respective finger back extensions at respective distal ends thereof.

16. An archer's glove comprising:

a finger back section and a plurality of finger protectors for protecting a plurality of fingers of a user's hand, the plurality of finger protectors extending from the finger back section; and securing means for releasably securing the finger back section to the plurality of fingers of the user's hand, wherein the location of the securing means is adapted to be at a palm side of the plurality of fingers of the user's hand, wherein the plurality of finger protectors includes a plurality of finger back extensions which form part of the finger back section and a plurality of finger tip stalls attached to the respective finger back extensions, the plurality of finger back extensions and finger tip stalls being adapted to receive therebetween the respective plurality of fingers of the user's hand.

17. An archer's glove comprising:

a finger back section and a plurality of finger protectors for protecting a plurality of fingers of a user's hand, the plurality of finger protectors extending from the finger back section; and securing means for releasably securing the finger back section to the plurality of fingers of the user's hand, wherein the location of the securing means is adapted to be at a palm side of the plurality of fingers of the user's hand;

wherein the securing means includes a finger fastening strap for extending from the finger back section to the plurality of fingers of the user's hand;

wherein the finger back section includes a finger back cuff tunnel through which the finger fastening strap passes, the finger back cuff tunnel being adapted to extend in a direction transverse the plurality of fingers of the user's hand when the archer's glove is arranged with respect to the user's hand.

18. An archer's glove as set forth in claim 17, wherein at least a portion of the finger fastening strap is integrally connected to the finger back section.

19. An archer's glove as set forth in claim 17, wherein the finger fastening strap is adapted to wrap around one or more of the plurality of fingers of the user's hand.

20. An archer's glove as set forth in claim 17, wherein the finger back cuff tunnel forms a pair of openings at opposite ends thereof.

21. An archer's glove as set forth in claim 17, wherein the finger back cuff tunnel runs at least a portion of the width of the glove.

22. An archer's glove comprising:

a finger back section and a plurality of finger protectors for protecting a plurality of fingers of a user's hand, the plurality of finger protectors extending from the finger back section; and securing means for releasably securing the finger back section to the plurality of fingers of the user's hand, wherein the location of the securing means is adapted to be at a palm side of the plurality of fingers of the user's hand;

wherein the securing means includes a finger fastening strap extending from the finger back section to the plurality of fingers of the user's hand;

wherein the finger back section includes a finger back cuff tunnel sized to enable passing therethrough of the finger fastening strap;

wherein the finger back cuff tunnel forms a pair of openings at opposite ends thereof;

wherein one of the openings is at an index finger side of the glove and the other of the openings is at a third finger side of the glove.

23. An archer's glove comprising:

a finger back section and a plurality of finger protectors for protecting a plurality of fingers of a user's hand, the plurality of finger protectors extending from the finger back section; and securing means for releasably securing the finger back section to the plurality of fingers of the user's hand, wherein the location of the securing means is adapted to be at a palm side of the plurality of fingers of the user's hand;

wherein the securing means includes a finger fastening strap extending from the finger back section to the plurality of fingers of the user's hand;

wherein the finger back section includes a finger back cuff tunnel sized to enable passing therethrough of the finger fastening strap;

wherein the, finger back cuff tunnel includes a check stitch which narrows the passage of the finger back cuff tunnel thereby to at least partially restrict movement of the finger fastening strap through the finger back cuff tunnel.

24. An archer's glove comprising:

a finger back section and a plurality of finger protectors for protecting a plurality of fingers of a user's hand, the plurality of finger protectors extending from the finger back section; and a user's loop extending from the finger back section for releasably securing the finger back section to the plurality of fingers of the user's hand;

wherein the user's loop is selectively adjustable between an open position whereby the plurality of fingers of the user's hand may be inserted therethrough and a closed taught position whereby the user's loop secures the finger back section to the plurality of fingers of the user's hand;

wherein the plurality of finger protectors includes a plurality of finger back extensions which form part of the finger back section and a plurality of finger tip stalls attached to the respective finger back extensions, the plurality of finger back extensions and finger tip stalls being adapted to receive therebetween the respective plurality of fingers of the user's hand.

25. An archer's glove comprising:

a finger back section and a plurality of finger protectors for protecting a plurality of fingers of a user's hand, the plurality of finger protectors extending from the finger back section; and a user's loop extending from the finger back section for releasably securing the finger back section to the plurality of fingers of the user's hand;

wherein the finger back section includes a finger back cuff tunnel through which the user's loop passes, the finger back cuff tunnel being adapted to extend in a direction transverse the plurality of fingers of the user's hand when the archer's glove is arranged with respect to the user's hand; and wherein the user's loop is selectively adjustable between an open position whereby at least one of the plurality of fingers of the user's hand may be inserted therethrough and a closed taught position whereby the user's loop secures the finger back section to the at least one of the plurality of fingers of the user's hand.

26. An archer's glove as set forth in claim 25, wherein at least a portion of the user's loop is integrally connected to the finger back section.

27. An archer's glove as set forth in claim 25, wherein the user's loop is adapted to wrap around one or more of the plurality of fingers of the user's hand.

28. An archer's glove as set forth in claim 25, wherein the closed taught position is adapted to be at a base portion of the plurality of fingers of the user's hand.

29. A method of arranging an archer's glove with respect to a user's hand, wherein the glove includes a finger back section and a plurality of finger protectors for protecting a plurality of fingers of the user's hand, the plurality of finger protectors extending from the finger back section, and a finger fastening strap extending from the finger back section for releasably securing the finger back section to the plurality of fingers of the user's hand, the finger back section including a finger back cuff tunnel through which the finger fastening strap passes, the method comprising the steps of:

inserting the plurality of fingers of the user's hand into the respective plurality of finger protectors;

arranging the finger back section adjacent to the user's hand so that the finger back tunnel extends transverse the plurality of fingers of the user's hand;

inserting the finger fastening strap into and through the finger back cuff tunnel;

wrapping the finger fastening strap around at least one of the plurality of fingers of the user's hand to secure the finger back section to the plurality of fingers of the user's hand.

30. A method as set forth in claim 29, wherein the step of wrapping is before the step of inserting.

31. A method as set forth in claim 29, wherein the step of wrapping is before the step of inserting the finger fastening strap.

32. A method as set forth in claim 29, wherein the step of inserting the plurality of fingers is so that the finger back section is adjacent to a back portion of the user's hand.

* * * * *